US009697958B2

(12) United States Patent
Uitto et al.

(10) Patent No.: US 9,697,958 B2
(45) Date of Patent: Jul. 4, 2017

(54) MOVABLE CONTACT OF ELECTRIC SWITCH

(71) Applicant: ABB OY, Helsinki (FI)

(72) Inventors: Oskari Uitto, Vaasa (FI); Aki Suutarinen, Vaasa (FI)

(73) Assignee: ABB Oy, Helsinki (FI)

( * ) Notice: Subject to any disclaimer, the term of this patent is extended or adjusted under 35 U.S.C. 154(b) by 40 days.

(21) Appl. No.: 14/744,896

(22) Filed: Jun. 19, 2015

(65) Prior Publication Data

US 2015/0287551 A1 Oct. 8, 2015

Related U.S. Application Data

(63) Continuation of application No. PCT/FI2013/050439, filed on Apr. 19, 2013.

(30) Foreign Application Priority Data

Dec. 20, 2012 (FI) ..... 20126349

(51) Int. Cl.
*H01H 19/10* (2006.01)
*H01H 1/20* (2006.01)
(Continued)

(52) U.S. Cl.
CPC ..... *H01H 1/2041* (2013.01); *H01H 1/365* (2013.01); *H01H 1/42* (2013.01);
(Continued)

(58) Field of Classification Search
CPC ..... H01H 1/42; H01H 1/06; H01H 19/10; H01H 1/2041; H01H 13/365; H01H 19/02; H01H 2235/03; H01H 33/08
(Continued)

(56) References Cited

U.S. PATENT DOCUMENTS 3,137,778 A 6/1964 Barr
3,780,239 A 12/1973 Guidosh
(Continued)

FOREIGN PATENT DOCUMENTS

EP 1213730 B1 1/2010
ES 2180421 * 10/2002 ..... H01H 1/36
(Continued)

OTHER PUBLICATIONS

International Search Report (PCT/ISA/210) mailed on Jul. 16, 2013, by the Finnish Patent Office as the International Searching Authority for International Application No. PCT/EP2013/050439.
(Continued)

*Primary Examiner* — Edwin A. Leon
*Assistant Examiner* — Ahmed Saeed
(74) *Attorney, Agent, or Firm* — Taft Stettinius & Hollister LLP

(57) ABSTRACT

A movable contact of a rotary switch, including a pair of contact blades for making an electrical contact to a stationary contact receivable between the contact blades. The movable contact includes a traction member for providing a traction force between the contact blades, wherein the traction member is a unitary piece including two frame portions for framing the pair of contact blades, the traction member including a spring portion for pressing one of the contact blades against the other contact blade, wherein the spring portion is arranged between the two frame portions arranged at a distance from each other.

18 Claims, 9 Drawing Sheets

(51) Int. Cl.

| | |
|---|---|
| ***H01H 1/42*** | (2006.01) |
| ***H01H 1/36*** | (2006.01) |
| *H01H 11/00* | (2006.01) |
| *H01H 19/64* | (2006.01) |
| *H01H 19/02* | (2006.01) |

(52) U.S. Cl.
CPC ..... *H01H 19/10* (2013.01); *H01H 11/00* (2013.01); *H01H 19/02* (2013.01); *H01H 19/64* (2013.01)

(58) Field of Classification Search
USPC ..... 200/275, 243, 258, 571, 254–260
See application file for complete search history.

(56) References Cited

U.S. PATENT DOCUMENTS

| | | | |
|---|---|---|---|
| 4,778,959 | A | 10/1988 | Sabatella et al. |
| 6,222,139 | B1 | 4/2001 | Pandit et al. |
| 2014/0090969 | A1 | 4/2014 | Uitto et al. |

FOREIGN PATENT DOCUMENTS

| | | | | |
|---|---|---|---|---|
| FR | 2618591 | * | 3/1990 | ..... H01H 1/36 |
| WO | WO 2011/082528 A1 | | 7/2011 | |
| WO | WO 2012/168553 A1 | | 12/2012 | |

OTHER PUBLICATIONS

Office Action issued on Sep. 26, 2013, by the Finnish Patent Office in corresponding Finnish Patent Application No. 20126349. (5 pages).

Canadian Office Action dated Sep. 9, 2016; Canadian Intellectual Property Office; Application No. 2,895,965; 4 pgs.

English translation of Chinese Office Action; The State Intellectual Property Office of the People's Republic of China; Application No. 201380067686X; 4 pgs.

European Office Action dated Feb. 22, 2016; European Patent Office; Application No. 13 865 502.2; 6 pgs.

* cited by examiner

MOVABLE CONTACT OF ELECTRIC SWITCH

RELATED APPLICATION(S)

This application claims priority as a continuation application under 35 U.S.C. §120 to PCT/FI2013/050439, which was filed as an International Application on Apr. 19, 2013 designating the U.S., and which claims priority to Finnish Application 20126349 filed in Finland on Dec. 20, 2012. The content of each prior application is hereby incorporated by reference in its entirety.

FIELD

The disclosure relates to electric switches, for example, to a movable contact of a rotary electric switch.

BACKGROUND INFORMATION

In a rotary switch, a movable rotary contact can be arranged to rotate such as to connect to or disconnect from stationary contacts of the switch. To ensure optimal electric properties of the switch, the movable contact should have good electric conduction properties. For this purpose, it is also desirable that the contact between the movable contact and the stationary contact(s) should be tight such that forming of an air gap between them, in a connected state, can be prevented.

Furthermore, it can be desired that the movable contact can be easy to assemble. In view of known structures, an improved movable contact is disclosed herein.

SUMMARY

A movable contact of a rotary switch is disclosed, comprising: a pair of contact blades for making an electrical contact to a stationary contact receivable between the contact blades; and a traction member for providing a traction force between the contact blades, wherein the traction member is a unitary piece including: a frame having at least two frame portions which frame the pair of contact blades, and which are arranged at a distance from each other; and a spring portion for pressing one of the contact blades against the other contact blade, wherein the spring portion is arranged between the two frame portions.

A traction member of a movable contact for an electric switch is disclosed, comprising: two frame portions for enveloping a pair of contact blades; a spring member arranged between the frame portions for providing an attraction force between the contact blades; and a locking member for locking the contact blades to the traction member for preventing longitudinal movement of the contact blades with respect to the traction member.

A contact blade of a movable contact of an electric switch is disclosed, comprising: a separation member for keeping the contact blade separated from another contact blade; and a locking member for preventing longitudinal movement of the contact blade.

BRIEF DESCRIPTION OF THE DRAWINGS

In the following, exemplary embodiments of disclosure will be described in more detail referring to drawings, wherein.

DETAILED DESCRIPTION

Exemplary embodiments of the disclosure relate to rotary switches having a rotary contact and stationary contacts. The rotary contact can be arranged to rotate about a rotation axis, and the stationary contacts can be arranged opposite to each other with respect to the rotation axis of the rotary contact.

The rotary contact according to an exemplary embodiment of the disclosure can have a sandwich structure having two contact blades arranged at a distance from each other for receiving a stationary contact between the contact blades.

For example, the movable contact can have an elongate structure. The movable contact can be arranged to contact stationary contacts at both ends of the movable contact. Making and breaking the contact can occur simultaneously at both ends of the movable contact.

The contact blades of the movable contact can be arranged at a distance from each other by a separation member. The separation member can be a protrusion in the contact blade made by punching. Both contact blades can be similar, whereby the protrusions can set against each other thus together forming the total minimum separation between the contact blades. When the stationary contact can be guided between the contact blades, the contact blades can move further away from each other than provided by the separation member(s).

There can be provided a traction member for attracting the contact blades towards each other. The traction member can include a spring member at least on one side of the pair of contact blades. The traction member can include at least two frames framing or circumventing the pair of contact blades when the contact blades are set against each other. The frames can limit the movement of the contact blades in the direction transverse to the longitudinal direction of the contact blades. The traction member can be a unitary piece.

The traction member and/or the contact blades can include means for preventing their longitudinal movement with respect to each other. In an exemplary embodiment according to the disclosure, each contact blade can include a stud or pin, and the traction member can include a hole, which when fitted together, can prevent their mutual longitudinal movement. In another exemplary embodiment according to the disclosure, the contact blade can include a recess or groove for receiving a wall of the frame of the traction member. The wall of the traction member can include a protrusion or wing to be placed into the groove of the contact blade.

Figure 1:
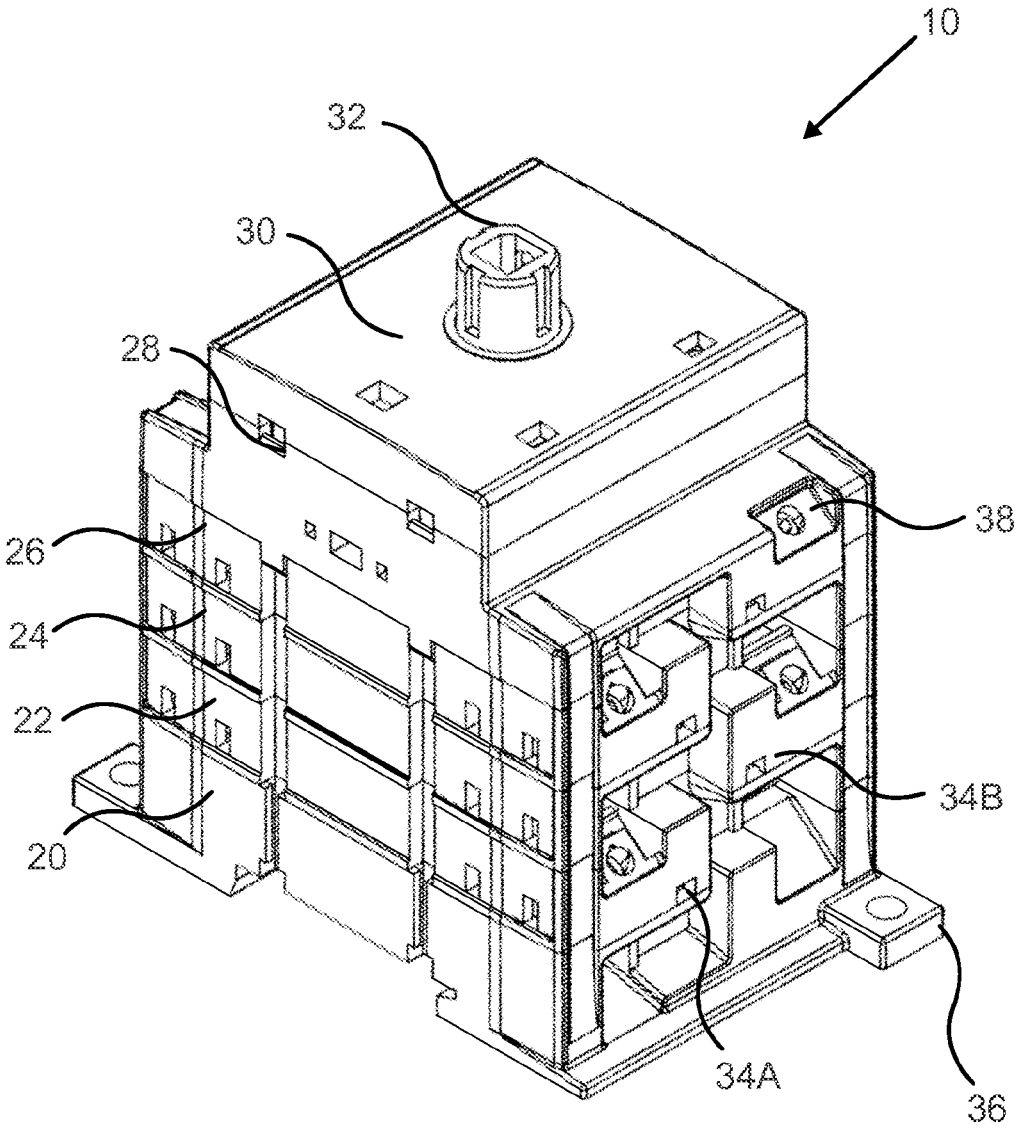
FIG. 1 shows an exemplary embodiment of a switch.

FIG. 1 shows an exemplary embodiment of a switch 10 applicable in the context of the present disclosure. The shown embodiment can be a four-pole switch but the number of the poles can be different and can be any number up to ten, for example. There can be a switch module per each pole. In FIG. 1, there can be a base module 20 and three intermediate modules 22, 24 and 26. On top of the highest intermediate module 26, there can be arranged a mechanism module taking care of the rotation actions of the switch. The mechanism module 28 can have a cover 30. Through the cover extends the rotation shaft 32. A handle (not shown) can be attached to the rotation shaft to enable operation of the switch.

The base and intermediate bodies have holes for receiving and tightening a current conductor with a connector screw 38. FIG. 1 also shows gas exhaust holes 34A, 34B in some of the modules. There can also be shown a fastening member 36 for attaching to switch to a mounting plate, for example.

Figure 2:
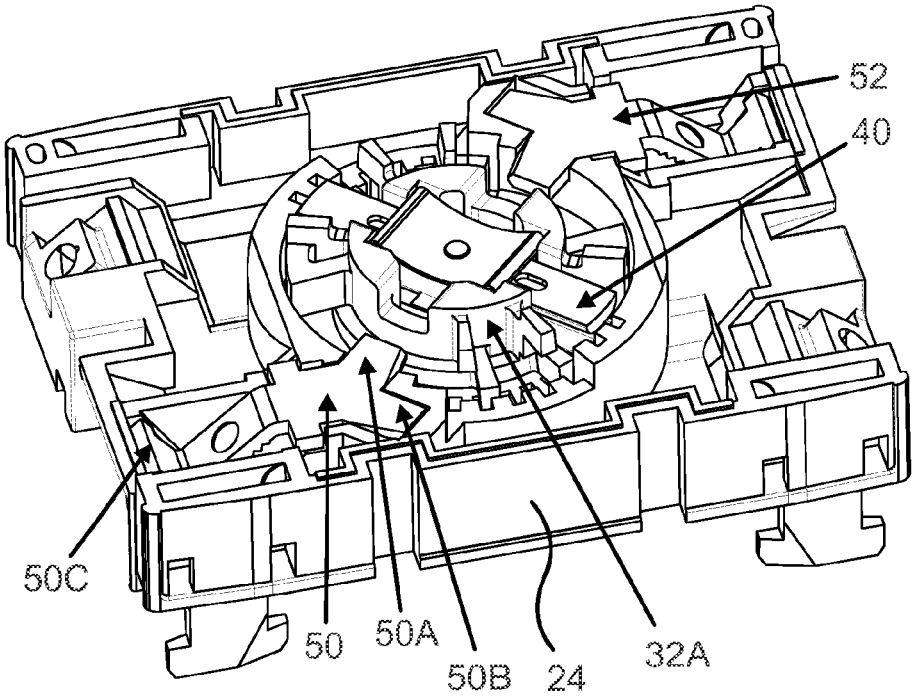
FIG. 2 shows a contact module according to an exemplary embodiment of the disclosure having the contacts in open position.
Figure 3:
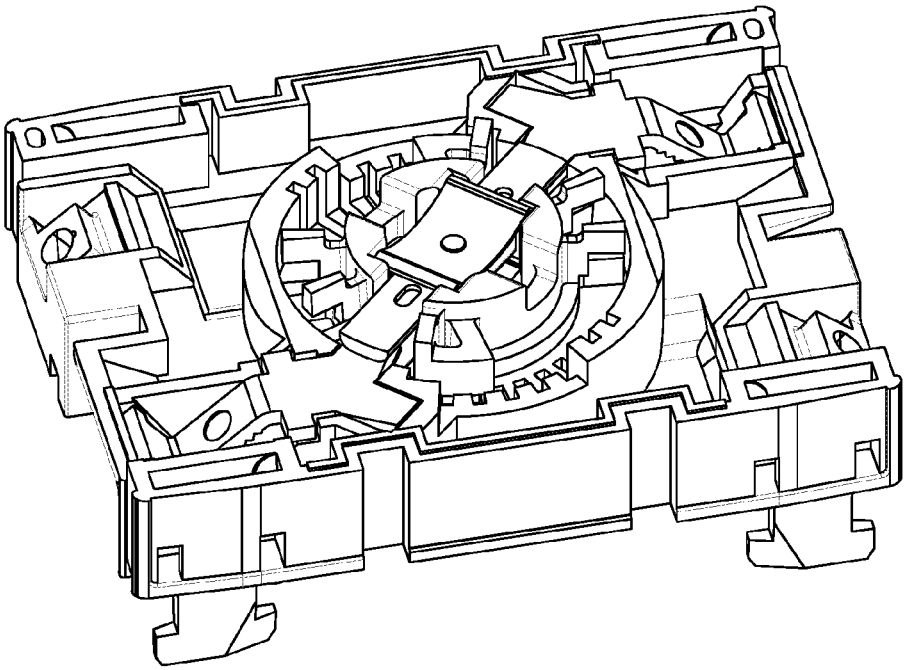
FIG. 3 shows a contact module according to an exemplary embodiment of the disclosure having the contacts in closed position.

FIGS. 2 and 3 show an exemplary embodiment on an equipped intermediate module according to the disclosure, FIG. 2 showing the module in the disconnected state, and FIG. 3 in the contacted state.

Within the module 24, there are arranged two stationary contacts 50 and 52 opposite to each other with respect to the rotation shaft, or rotation axis of the switch. To the module, there can be arranged a roll 32A, which forms part of the rotation shaft of the switch. A movable contact 40 can be arranged to the roll 32A such that rotation of the roll causes the movable contact 40 to pivot between the open position of the switch shown in FIG. 2 and the closed position of the switch shown in FIG. 3. In the open position of the switch, a contact bridge between the stationary contacts can be broken. In FIG. 3, the movable contact forms the contact bridge. The contact blades make an electrical contact to the stationary contact received between the contact blades. The rotation of the rotary contact can be arranged such that when the rotary contact can be rotated from the open position to the closed position, the rotation shaft and the roll are rotated clockwise, and vice versa. The rotation angle between the states can be 90 degrees, for example.

In the shown embodiment, the stationary contact can have a shape of letter Y. The base 50C of the stationary contact can be used for connecting the stationary contact to an external conductor. The right hand branch 50B, a support portion, can be set into a recess formed into the module, thus preventing pivoting of the stationary contact. The left hand branch, the contact portion of the stationary contact, can be adapted to make the contact to the contact blades of the rotary contact 40.

Figure 4:
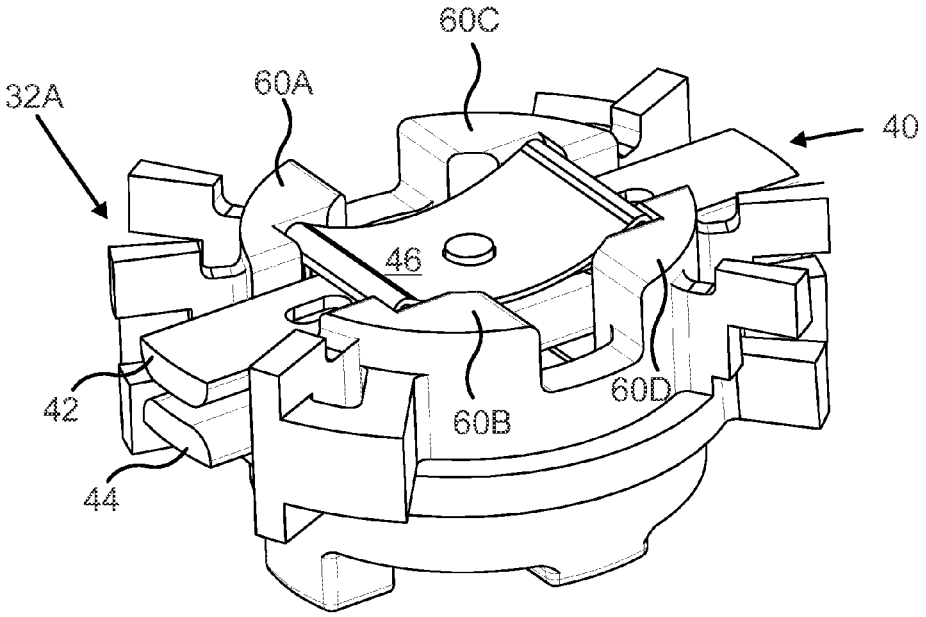
FIG. 4 shows a force transmission roll according to an exemplary embodiment of the disclosure having a movable contact placed therein.

FIG. 4 highlights the positioning of the movable contact to the roll 32A according to an exemplary embodiment of the disclosure. It can be seen that the roll can have four vertical bars 60A, 60B, 60C and 60D. The bars are arranged at a distance from each other such that a slot can be formed there between. The slot can be formed by a space between bars 60A and 60B, and between bars 60C and 60D. In the case of bars 60A and 60B, the portion of the slot can be formed by those portions of the bars that are closest to each other.

The movable contact includes three parts, a first contact blade 42, a second contact blade 44 and a traction member 46. The contact blades are elongate/longitudinal bars, which extend through the roll from one side to the opposite side of the roll, and via the rotation axis of the roll. The contact blades 42, 44 can be similar to each other. Each contact blade can be symmetric.

The distance between the bars 60A and 60B can, for example, be substantially the same as the width of the contact blades 42, 44 such that the contact blades fit into the slot with a tight fitting. The space between the bars 60A, 60B, and bars 60C, 60D with respect to the width of the contact bar can be such as to prevent pivoting of the contact blades to each other and the movable contact as a whole with respect to the roll 32A.

Figure 5:
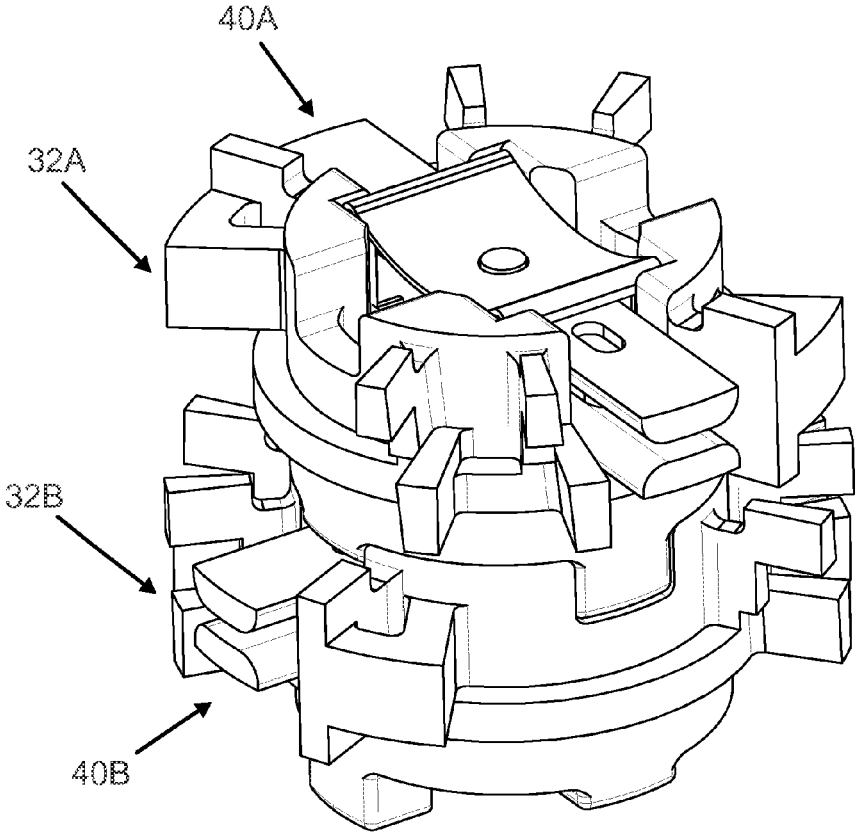
FIG. 5 shows two force transmission rolls according to an exemplary embodiment of the disclosure having movable contacts placed therein.

As the FIGS. 4 and 5 show, the traction member can be shorter than the contact blades. The traction member fits within the interior of the roll. Furthermore, the traction member can be wider than the contact blades. There are insertions in the bars 60A to 60D, which form a space for receiving the traction member with a tight fitting. The space for receiving the traction member can be rectangular. The space can be tight such that pivoting of the traction member about the roll can be prevented.

Between the bars 60A, 60C, and the bars 60B, 60D are arranged spaces, which are for receiving teeth of another roll to be mounted above the shown roll 32A. Such a roll can be another roll similar to the shown roll 32A, or a mechanism roll of a mechanism body.

FIG. 5 shows an exemplary embodiment according to the disclosure, where two rolls 32A, 32B have been mounted on top of each other. There two rolls form part of the rotation shaft of the switch. The shaft can additionally include one or more rolls similar to the rolls 32A, 32B, a crank, a mechanism roll and a handle. The rolls 32A, 32B are mounted to each other by teeth on the bottom of each roll that fit into respective recesses in an underlying roll.

Each roll can include a movable contact. Although the embodiment of FIG. 5 shows both rolls having a movable contact, the stack of rolls can also include empty rolls having no movable contact mounted thereto.

In the embodiment of FIG. 5, the movable contact 40A of the higher roll 32A can be perpendicular to the movable contact 40B in the lower roll. This can be advantageous in separating arcs formed in the top roll and the bottom roll as far as possible from each other, as the both movable contacts 40A, 40B are contacted from the respective stationary contacts simultaneously.

Figure 6:
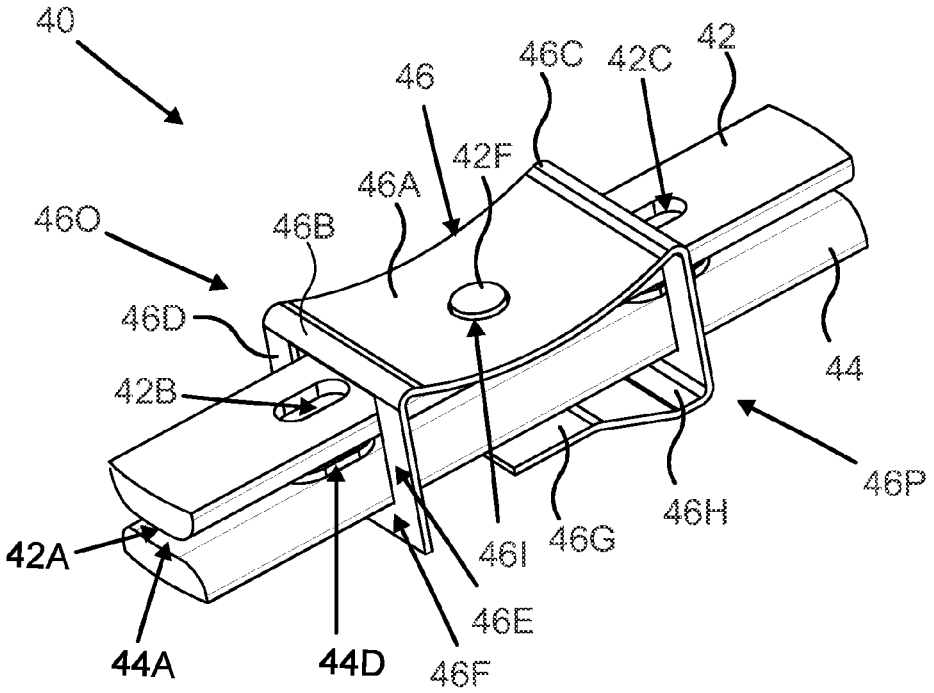
FIG. 6 shows a movable contact according to an exemplary embodiment of the disclosure.

FIG. 6 shows an embodiment of a movable contact 40 according to an exemplary embodiment of the disclosure in more detail. The movable contact of the embodiment can have three separate parts, a first contact blade 42, a second contact blade 44, and a traction member 46 for pulling the contact blades against each other and/or keeping the contact blades longitudinally in alignment with each other. Furthermore, the traction member keeps the two separate contact blades together as a package. In FIG. 6, the three parts have been mounted together.

The contact blades can be mutually similar and/or symmetrical. The contact blade can be a longitudinal blade, which can have a cross-section of substantially letter D. The straight section of the D-formed cross-section sets on the outside of the contact blade, and the rounded side of the contact blade sets to the inside of the movable contact. The rounded sides of the contact blades are set against each other. This can alleviate the receiving of the stationary contact between the contact blades. When being between the contact blades, the stationary contact sets against the rounded contact surfaces 42A, 44A of the contact blades.

FIG. 6 shows the movable contact in a situation where a stationary contact is not placed between the contact blades. In this situation, the contact blades are kept separate from each other by using separation members. The separation members can be parts that have been made by punching to the contact blades from the outside of the contact blade. FIG. 6 shows two such separation members 42B, 42C that have been punched to the first contact blade 42. The punched portion extends as a protrusion to the contact surface 42A of the contact blade.

FIG. 6 also shows how the punched protrusion extends as a separation member 44D to the contact surface 44A of the second contact blade 44. Each contact blade can have two such separation members, which are positioned at an equal distance from each other from the middle of the contact blade. The separation member(s) of both contact blades set against each other thus keeping the contact blades distanced from each other. When a stationary contact can be placed between the contact blades, the separation members of the two contact blades can separate from each other.

In addition to the contact blades, the movable contact also includes a traction member 46. One purpose of the traction member can be to pull/press the contact blades against each other, both in a situation when there can be no stationary contact between the contact blades, and in a situation when there can be stationary contact between the contact blades thus providing a contact pressure between the contact blades and the stationary contact. When there can be a stationary contact between the contact blades, the traction force provided by the traction member can be higher than when there can be no stationary contact between the contact blades.

Making the contact by guiding the stationary contact between the contact blades thus tensions the one or more springs of the traction member. The traction member thus provides the needed contact pressure between the contact blades, and also to maintain the integrity of the movable contact. That can be, the traction member can also be arranged to keep the contact blades in place.

The traction member shown in FIG. 6 can be unitary. Thus, it can be made as one piece. The different portions of the unitary/integral traction member are thus not separable without breaking the structure. The traction member can be made of a single metal plate by first cutting the metal plate to the desired size, making the needed holes to it, and finally bending the obtained piece of plate into shown form.

The traction member includes two frames portions (e.g., frames 46O, 46P arranged at a distance from each other. The frames can be arranged longitudinally of the contact blades on both sides about the middle point of the contact blades. The distances of the frames can be equal from the middle of the contact blade.

The frames are arranged to frame, at least partially, the pair of contact blades from all sides. That is, when the contact blades are set against each other, the frames can surround the pair of contact blades from all four sides.

For example, the frame(s) make a full encircle around the contact blades thereby providing maximal support for the contact blades. In an alternative exemplary embodiment according to the disclosure, on one side of the contact blades, the frame covers only part of the side. For example, on the side of the second contact blade, the frame can include short horizontal portions giving support for the second contact blade but not covering the whole width of the second contact blade. In the frame, the frame sides other than the horizontal bar 46B can support and touch at least one of the contact blades 42, 44 all the time. Framing thus can refer to there being at least a portion of the frame on each side of the pair of contact blades. The frame does not necessarily, however, touch the pair of contact blades from all sides.

The frames 46O, 46P are connected by a spring element 46A, which sets against the outer surface of one of the contact blades. In this way, the spring provides a constant contact pressure pressing the contact blades against each other. Various embodiments of the traction member will become apparent from the following examples. It can be noted that even though the following examples make reference to directions such as horizontal, vertical, left, top, and so on, these are to be understood as only illustrating the shown embodiments and can vary depending on the usage position of the switch.

In FIG. 6, the traction member 46 includes a first spring portion 46A having a first end 46B and a second end 46C. In the middle of the spring portion in the longitudinal direction, the spring portion 46A can be in contact with the outer surface of the first contact blade 42, whereas the ends 46B, 46C are arranged at a distance from the contact blades. The middle portion between the ends can be thus tensioned such that it forms a curve. The curved portion can be substantially uniform between the ends of the spring. The ends can have sloping, downwards extending strengthened portions to prevent buckling of the middle portion. Bucking can also be prevented by limiting the movement of the contact blades such that the spring never reaches its bucking dead point. Thus, when a stationary contact can be placed between the contact blades, the spring portion 46A straightens a little but the curved form can be still maintained at least to some extent.

The traction member thus includes two frames 46O, 46P arranged at a distance from each, the distance being the length of the spring connecting the frames. The frames are arranged at the ends of the spring. In the embodiment of FIG. 6, the first frame 46O includes a set of bars 46B, 46D, 46E and 46F, which are arranged perpendicular to each other. The bars can thus form a rectangular frame for limiting the movement of the contact blades placed within the interior of the frame. The second frame 46P can be provided similarly at the other end of the spring 46A. The two frames can be similar but can also differ from each other.

Even though FIG. 6, and other Figures show the frames as continuous frames surrounding the pair of contact blades completely, it can also be possible to provide a partly discontinuous frame. For example, in FIG. 6, the bar 46F can be broken from the middle, even though this can be a suboptimal solution. Such a frame, however, supports the contact blade from all sides. That can be, the pair of contact blades are supported by the frame from the top, bottom, left and right.

In an exemplary embodiment according to the disclosure, the vertical side bars 46D and 46E are arranged at such a distance that the contact blades can be placed between them with a tight fitting. Thus, horizontal movement and pivoting of the contact blades with respect to the traction member can be prevented.

In an exemplary embodiment according to the disclosure, there can be predetermined clearance between the horizontal bars 46B and 46F. When there can be no stationary contact between the contact blades, the spring portion 46A forces the second contact blade 44 against the horizontal bar 46F. In that situation, there can be a gap between the horizontal bar 46B and the outer side of the contact blade 42. However, the distance between the horizontal bars 46B and 46F can be dimensioned such that when the stationary contact can be placed between the contact blades 42, 44, the outer surface of the first contact blade 42 sets against the vertical bar 46B, and the outer surface of the second contact blade 44 sets against the vertical bar 46F. Alternatively, the horizontal bars 46B and 46F can be arranged at such a distance from each other that there can be a clearance between the outer surface of the first contact blade and the bar 46B even though there can be a stationary contact between the blades.

There can also be provided a second frame similar to the first frame. The second frame can be positioned at an equal distance from the middle point 46I of the traction member. The second end 46C thus forms one vertical bar of the rectangular second frame.

In an exemplary embodiment according to the disclosure, the traction member includes a first locking member for locking the first contact blade longitudinally to the traction member. Furthermore, the traction member can include a second locking member for locking the second contact blade longitudinally to the traction member.

The first locking member can include a hole 46I for receiving a stud/pin 42F formed to the first contact blade 42. The hole 46I can be arranged in the middle of the spring element 46A. The hole can be arranged longitudinally between the bars 46B, 46C in the middle of the spring. The hole can be in the middle of the spring also in the transverse direction to the longitudinal direction. The stud 42F can have been formed by punching to the first contact blade 42. The stud has been punched from the side of the contact surface of the first contact blade and thus forms a protrusion on the outer surface of the first contact blade. The stud 42F and the hole 46I can prevent the longitudinal movement of the first contact blade 42 with respect to the traction member 46.

The second locking member can be provided for locking the second contact blade longitudinally to the traction member. The second locking member can be highlighted with references 46G, 46H and 46J. The reference 46G refers to a locking portion, which can be continuously in contact with the outer surface of the second contact blade. There can be also provided a positioning portion 46H, which can be arranged at a distance from the outer surface of the contact blade. The locking portion 46G can be arranged at the same level as the lower bar 46F of the first frame and a corresponding bar of the second frame. The second locking member can include a similar stud-hole arrangement as the first locking member. That is, the second contact blade 44 can include a stud/pin on its outer surface, and the locking portion 46G of the locking member can include a hole 46J for receiving the stud of the second contact blade 44.

As can be seen, the second locking member 46H can be, for example, connected to only one of the frames. In this way, manufacture of the traction member can be possible by applying the stages of cutting into appropriate size, making the needed holes, and bending to appropriate shape.

Figure 7:
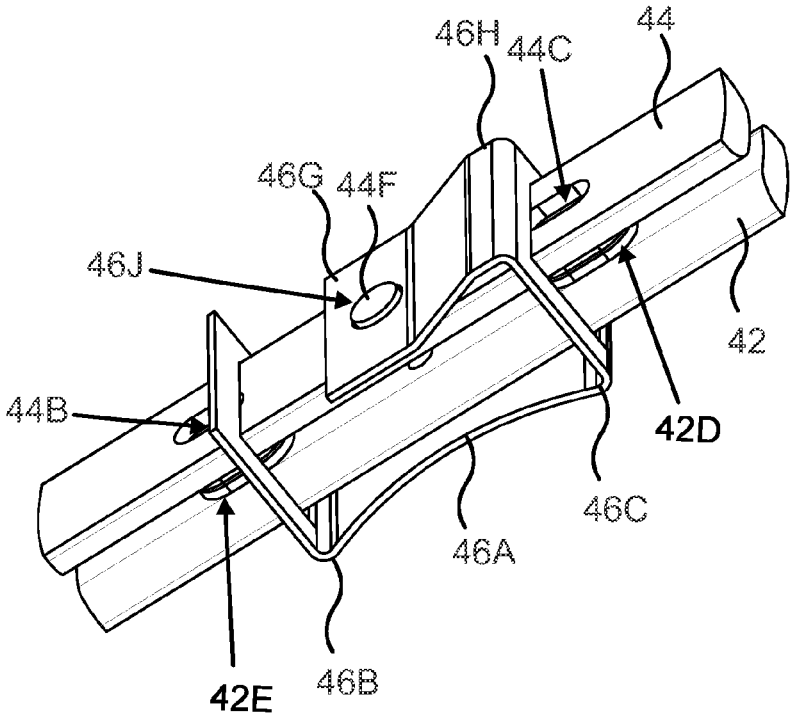
FIG. 7 shows another view of the movable contact of FIG. 6.

FIG. 7 shows another view of the movable contact of FIG. 6. In the figure, the movable contact can be shown from the underside such that the second contact blade 44 can be on the top and the first contact blade 42 can be on the bottom.

The figure shows the separation members 44B, 44C which have been punched from the second contact blade 44. The separation member 44C forms a protrusion on the inside that can be on the side of the contact surface of the first contact blade and sets against the separation member 42D of the first contact blade.

It can be seen that there can be arranged a locking member in the form of a stud 44F formed to second contact blade 44, which sets to a corresponding hole made to the second locking member 46G, 46H, 46J for locking and keeping the second contact blade 44 and the traction member 46 stationary to each other in the longitudinal direction of the elongate contact blade.

The second locking member includes a locking portion 46G, which can be a plane-like level which sets against the outer surface of the second contact blade 44. There can be also provided a positioning portion 46H for positioning of the locking portion. The positioning portion thus begins at the end of the locking portion and gradually distances from the positioning portion and finally connects to a bar of the frame.

The traction member can be, for example, made of metal, such as spring steel, for example.

In the exemplary embodiment of the disclosure shown in FIGS. 6 and 7 there can be provided a movable contact having two contact blades and a traction member for providing a traction force on the contact blades. There can be provided a spring element on a first side of the traction member for pressing the first contact blade against the second contact blade. In the shown embodiment, there are provided two support members in the form of frames at the ends of the spring element. Each support member can be provided in the form of a rectangular frame and they are provided at an equal distance from the middle of the contact blade.

The traction member can include a first locking member for locking of the first contact blade to the traction member, and a second locking member for locking of the second contact blade to the traction member. In the shown embodiment, the locking members can be implemented by holes in the both sides of the traction member, which holes are configured to receive studs arranged on the contact blades.

The traction member can be a unitary piece. The movable contact can be mounted by introducing the contact blades through one of the frames and pushing the contact blades so far that the studs on the outer sides of the contact blades click into the respective holes in the traction member. When placing the studs into the holes, the spring elements on both sides of the movable contact are slightly displaced from each other for receiving the studs.

Figure 8:
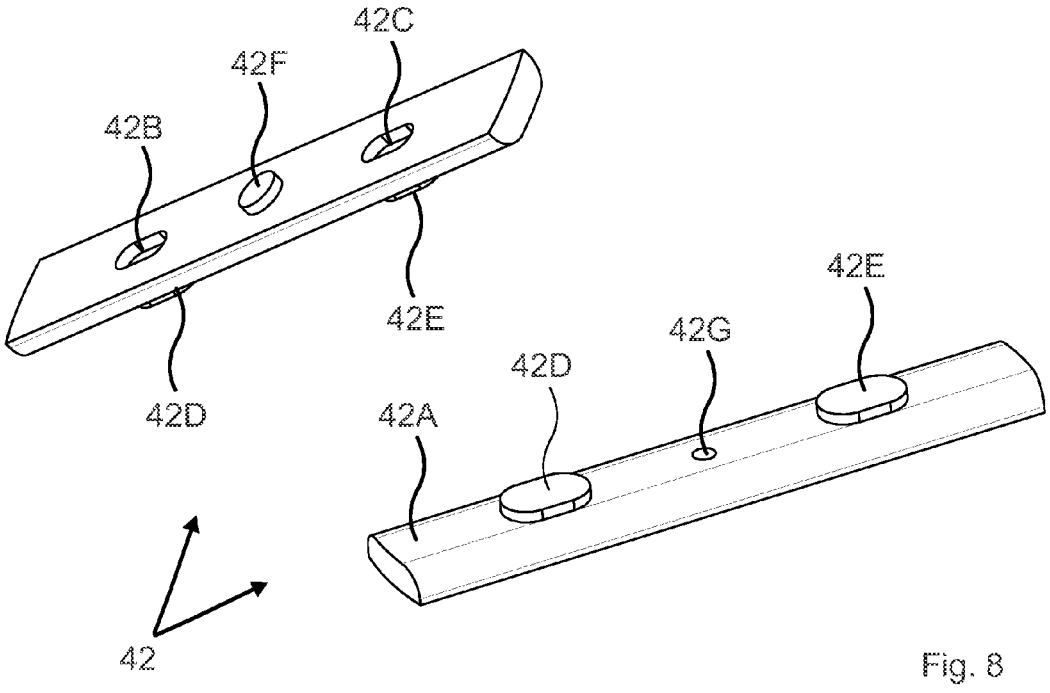
FIG. 8 shows the contact blades of the movable contact of FIG. 6.

FIG. 8 shows a contact blade 42 from two viewing angles, from the contact surface 42A, and from the outer side 42D. The contact blade can be punched from the direction of the outer side 42D to form recesses 42B, 42C, which appear on the contact surface 42A as respective protrusions 42D and 42E. The protrusions function as separation or spacer members for keeping the contact blades separated from each other such that a stationary contact can be received between the contact blades. There can be also a further protrusion 42F, which has been punched from the contact surface 42A such that a recess 42G can be formed to the side of the contact surface 42A. The protrusion 42F can be applied for locking the contact blade to the traction member.

Figure 9:
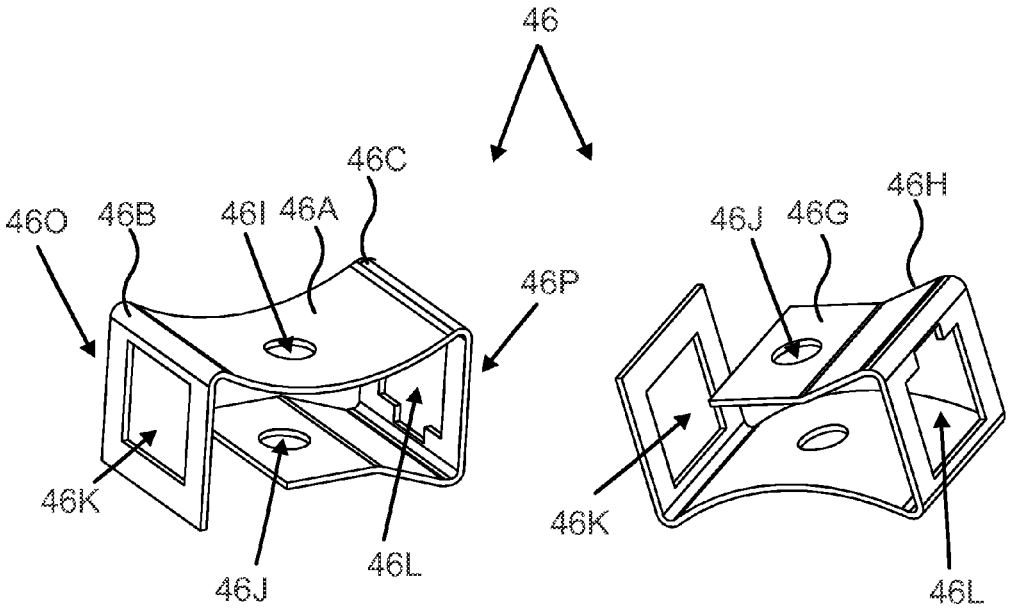
FIG. 9 shows two views of the traction member of the movable contact of FIG. 6.

FIG. 9 shows the traction member 46 from two viewing angles. The traction member can be a one-piece metallic integral part whose portions cannot be separated without breaking the integrity/unitarity of the member. The member can be flexible to certain extent such that the spring member can slightly flex by straightening when the contact can be being made, and when mounting the movable contact.

FIG. 9 shows holes 46I and 46J on the traction member 46 for receiving studs of the respective contact blades. FIG. 9 also shows two windows 46K, 46L formed by mutually perpendicular bars at opposite ends of the traction member. The window/frame 46K can be rectangular, and the window/frame 46L can be substantially rectangular. When mounting the movable contact, the contact blades are pushed to the traction member from the window 46L. The window/frame can have a recess on one or both of the horizontal bars for allowing the studs 42F of both contact blades to be inserted to the traction member. When inserting the contact blades to the traction member, the spring of the traction member can flex.

As the figures show, the traction member can be open from the side of the second locking member. The end of the positioning member 46G does not connect to the frame defining the window 46K. In this way, the manufacture of the unitary traction member can be facilitated.

As FIG. 9 shows, the spring element 46A connect to the ends 46B, 46C, which form one bars of the respective frames. The spring element can be a uniformly curved spring between the ends. The form of the spring can correspond to a sector of a circle. The middle of the spring sets closer to the contact blades than the ends of the spring.

The second locking member can include two portions, that can be the locking portion 46G and the positioning portion 46H. The locking portion can be arranged such that it sets substantially parallel to the contact blades. It can thus be substantially perpendicular to the plane of the frames. The positioning portions 46H can be arranged to an angle with respect to the locking portion 46G. When seen from the frame, the positioning portion inclines towards the other side of the traction member, that can be, towards the spring element.

Figure 10:
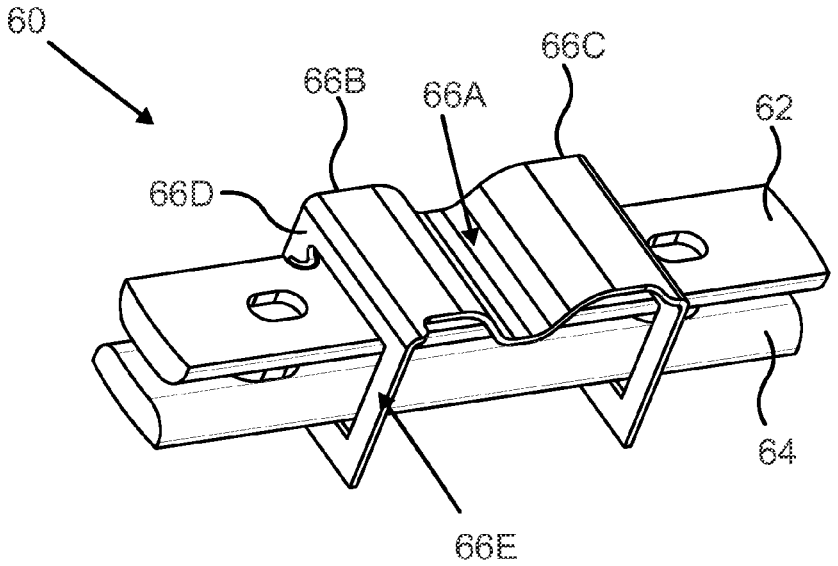
FIG. 10 shows a movable contact according to an exemplary embodiment of the disclosure.
Figure 11:
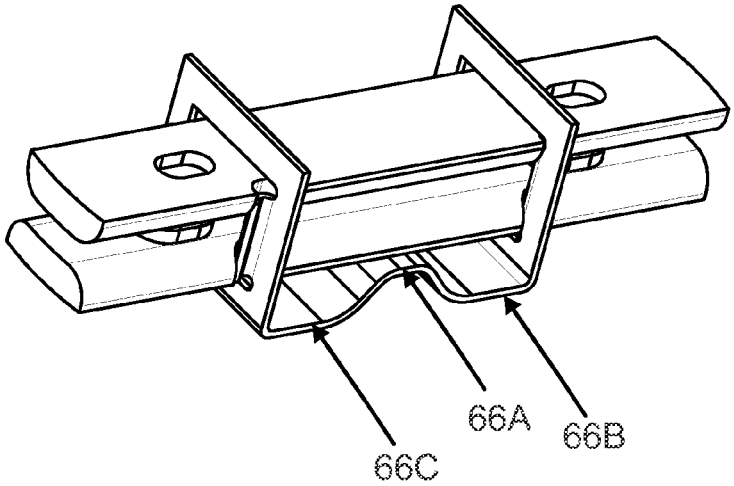
FIG. 11 shows another view of the movable contact of FIG. 10.
Figure 12:
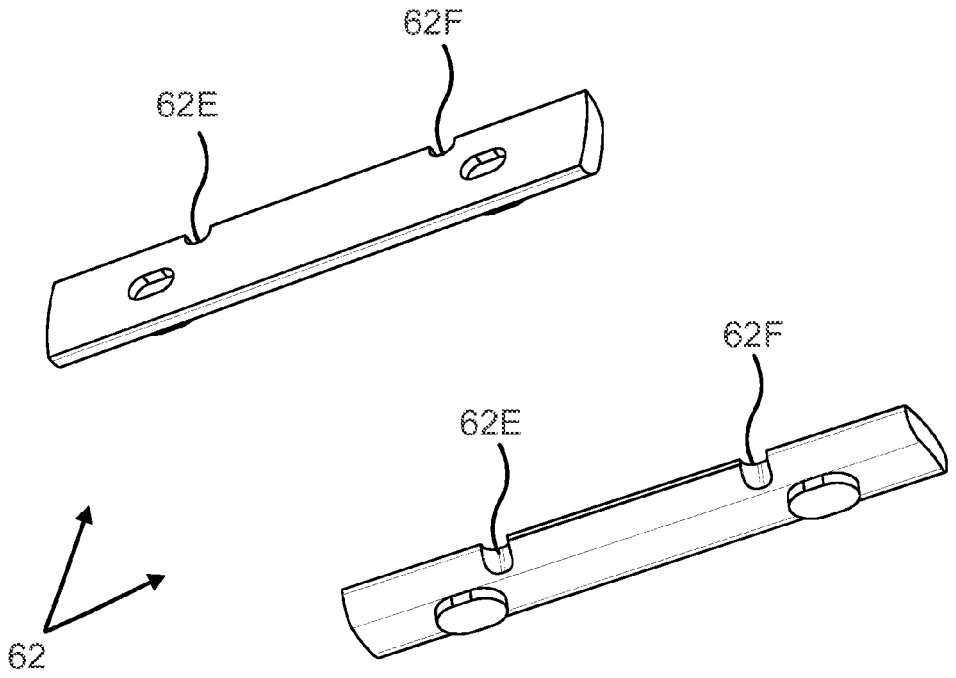
FIG. 12 shows the contact blades of the movable contact of FIG. 10.

FIGS. 10 to 13 illustrate another exemplary embodiment of the movable contact according to the disclosure. FIGS. 10 and 11 show the movable contact from the top, and the bottom. FIG. 12 shows the structure of the contact blades, and FIG. 13 further illustrates the traction member. The main elements of the movable contact shown in FIGS. 10 to 13 are the same as in the embodiment shown in FIGS. 6 to 9. There are two contact blades arranged at a distance from each other, and a unitary traction member for providing a contact pressure between the contact blades, and keeping the contact blades longitudinally fixed with respect to the traction member. The main differences between the two embodiments lie in the manner how the contact blades and the traction member are kept in place in longitudinal direction of the contact blades.

FIG. 10 shows the movable contact as a perspective view substantially from the top. There are two contact blades 62 and 64 for making an electrical contact to stationary contacts to be guided between the contact blades at both ends of the contact blades. The contact blades are provided for carrying electrical current between the ends of the contact blades that can be between the stationary contacts.

FIG. 10 also shows a unitary traction member made of one piece by applying plate machine-tooling methods such as cutting, piercing and bending. The traction member includes at least a spring element provided against the outer surface of the first contact blade, and two frames at the end of the first spring, which frames surround/encircle the contact blades.

The frames surround the contact blades at two separate positions in the longitudinal direction of the contact blades. Between the frames there can be no support to the contact blades on the sides of the contact blades. The contact blades can be supported/pressed between the frames on one or both outer surfaces of the contact blades.

As the frames surround the contact blades, the frames have bars that set against the sides of the contact blades. Thus, the spring that can be a continuation of the frame, can also be wider than the outer surface of the contact blade.

In the embodiment of FIG. 10, the movable contact can have a spring element, which sets against the outer surface of the first contact blade. The spring element shown in FIG. 10 can have a different form from the spring shown in FIG. 6. The spring of FIG. 10 can have two tensioning portions 66B and 66C extending from the frames, and a pressing portion 66A between the tensioning portions. The tensioning portions can be substantially parallel to the outer surface of the contact blade. The pressing portion forms a curve such as a parabola between the tensioning portions. The spring portion contacts the contact blade only by the pressing portion. The spring can be symmetric, in that the tensioning portions are similar and arranged similarly on both sides of the pressing portion.

FIG. 11 highlights the embodiment of FIG. 10 from the bottom. As can be seen, the first spring element can have two substantially planar tensioning portions 66B, 66C, and there can be a provided a ridge 66A forming the pressing portion between the tensioning portions. By way of an example the different portions can each make substantially one third of the horizontal length of the spring element.

FIGS. 10 and 11 show that the longitudinal fixing of the contact blades and the traction member to each other can be arranged by using the sides of the contact blades, and one or more vertical bars of the frames. This will be explained in more detail with reference to FIGS. 12 and 13.

FIG. 12 shows a contact blade from two viewing angles. The contact blades have some common features with the contact blades shown in FIGS. 6 to 9. Each contact blade can have separation members, which set against the corresponding separation members of the other contact blade. The separation members can be provided in one of the two contact blades, or in both of them.

The contact blade of FIG. 12 can have a locking member for locking and keeping the contact blade longitudinally fixed with the traction member. In FIG. 8, this locking member was provided by a protrusion 42F, 42G, which can be formed by punching from the side of the contact surface towards the outer surface such that a stud/protrusion can be formed on the outer surface. In the embodiment of FIG. 12, the mutual movement can be prevented by two receptacles 62E, 62F formed to the side of the contact blade. These receptacles or grooves are arranged to set against respective side walls of the two frames of the traction member.

As FIG. 12 shows, the receptacle can have a form of a half circle, or a parabola. Other forms are also possible.

Figure 13:
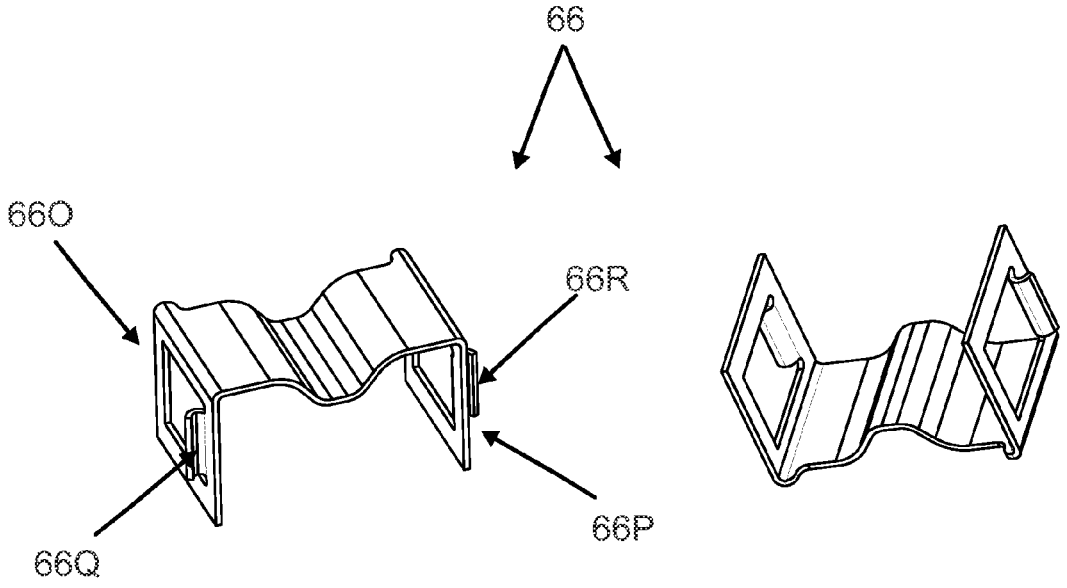
FIG. 13 shows two views of the traction member of the movable contact of FIG. 10.

FIG. 13 shows another exemplary embodiment of a traction member according to the disclosure. The traction member includes a spring on one side of the traction member for setting against the first contact blade. There are two frames at both ends of the traction member, wherein the frames are connected by the spring. The frames define windows through which the contact blades can be inserted to the interior of the frames.

The traction member includes a locking member for keeping the contact blade(s) longitudinally in place. In the shown embodiment, this locking member includes a wing formed to a side bar of the frame, which wing can be arranged to set to a groove provided in the contact blade. The wing can thus have a curved form, which can fit into a curved groove of the contact blade. The curved form of the wing can be such that the convex side of the curve sets towards the interior of the frame 66O. The wing can be provided in the vertical side bar of the frame. The wing can extend from the vertical side bar towards exterior of the traction member. The wing can have a vertical height such that it fits into the grooves of both contact blades which are arranged against each other inside the window defined by the frames of the traction member. There can be provided a wing in both of the frames, or in one of the frames only. Correspondingly, there can be provided one or two grooves/recesses on each contact blade.

FIGS. 6 to 13 show two exemplary embodiments of a movable contact according to the disclosure. There are some similarities between the embodiments, but also some differences. It can be understood that various modifications can be done to the shown embodiments and various combinations can be made of the two embodiments. Some of them will be shortly discussed in the following.

In an exemplary embodiment according to the disclosure, the traction member includes one spring element, which sets against the first contact blade. The spring presses the first contact blade against the second contact blade. The second contact blade can be thereby pressed against the frames, which provides thus the counter-force for the pressing force of the spring.

In an exemplary embodiment according to the disclosure, the spring member that sets against the contact blade can have a uniform, parabola-like form. In another exemplary embodiment according to the disclosure, the spring member can have a form where the parabola-like section can be only in the middle of the spring and there are two substantially planar sections on both sides of the middle portion.

In an exemplary embodiment according to the disclosure, the traction member includes a first locking member for locking the first contact blade to the traction member. The first locking member can include a hole made to the spring element.

In an exemplary embodiment according to the disclosure, the traction member includes a second locking member for locking the second contact blade to the traction member. The second locking member can include a hole made to a support member that sets against the outer surface of the second contact blade.

In an exemplary embodiment according to the disclosure, a vertical side bar of a frame of the traction member functions as the locking member. The same locking member can be arranged to lock both contact blades to the traction member.

The contact blade can include a corresponding locking member for locking to the traction member. In an exemplary embodiment according to the disclosure, the locking member includes a stud in the contact blade for locking to the spring and/or the support element.

In an exemplary embodiment according to the disclosure, the locking member provided in the contact blade includes a recess/groove in a side wall of the contact blade.

FIGS. 14 to 17 show another exemplary embodiment of a movable contact 80 according to the disclosure. As in the previous Figures, there are two contact blades and a traction member for keeping the contact blades in place with respect to each other. The contact blades can be mutually similar, or there can be slight differences between them.

Figure 14:
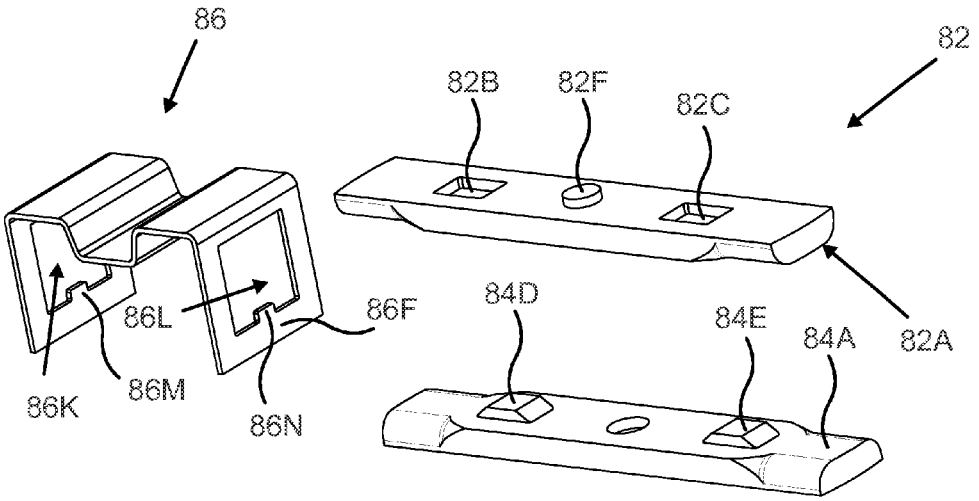
FIG. 14 shows a movable contact according to an exemplary embodiment of the disclosure.

The contact blades include contact surfaces 82A, 84A that are to be assembled so as to face each other and to receive a stationary contact between them. On the contact surface, one or both of the contact blades includes one or more separation members 84D, 84E for keeping the contact blades at a predetermined distance from each other. For example, the separation members have been obtained by punching from the opposite side such that recesses 82B, 82C are formed on the outer sides of the contact blades. As FIG. 14 shows, the form of the recess on the outer surface can be substantially rectangular. On the contact surface, the separation members 84D, 84E can appear as cut pyramids.

As in previous figures, also the traction member 86 of FIG. 14 can have two frames/windows 86K, 86L arranged at a distance from other. The frames are arranged to receive and envelope the pair of contact blades to the interior of the frames. The windows can be perpendicular to the longitudinal direction of the contact blades, and can be substantially rectangular. As shown, the horizontal bars, such as the bar 86F, of the windows can have a locking member 86M, 86N for co-operating with a locking member of a contact blade. The locking member(s) 86M, 86N can be arranged on the opposite side of the window than the spring member connecting the frames. The locking member of the window can be arranged as a protrusion that protrudes towards the interior of the window from the horizontal bar.

Figure 15:
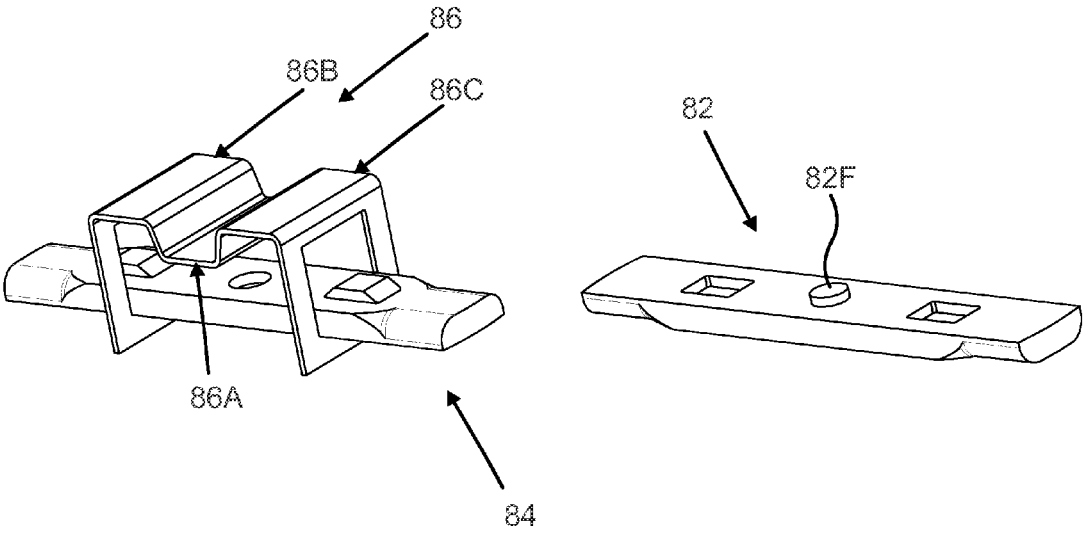
FIG. 15 shows a movable contact according to an exemplary embodiment of the disclosure partly assembled.

FIG. 15 illustrates the mounting of the movable contact. One of the contact blades 84 has been inserted to the interior of the windows such that the locking members provided on the vertical side bars of the two windows lock to the recesses on the outer sides of the contact blade 84. As FIG. 15 shows, the contact blade 84 that can be provided on the opposite side of the traction member than the spring member 86 can be assembled first.

When the first contact blade 84 has been assembled, the second contact blade 82 can be assembled to the interior of the frames. The second contact blade 82 can be locked to the traction member with the protrusion 82F that has been arranged to the outer surface of and to middle of the contact blade 82. That protrusion 82F can be inserted to a hole that can be provided in the spring member 86 that connects the two windows of the traction member. The hole can be similar to the hole 46I shown in FIG. 9. The spring can be arranged to the edges of the frames, and can include a middle portion 86A that sets closer to the contact blade 82 than the end portions 86B, 86C.

As shown in FIG. 15, the contact blades can be locked to the traction member with different locking members, although the contact blades can be mutually similar.

Figure 16:
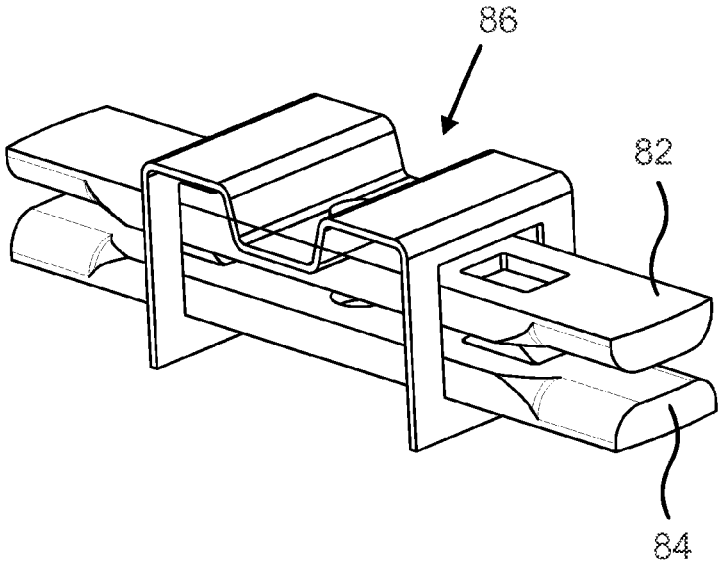
FIG. 16 shows a first view of the movable contact according to an exemplary embodiment of the disclosure assembled.
Figure 17:
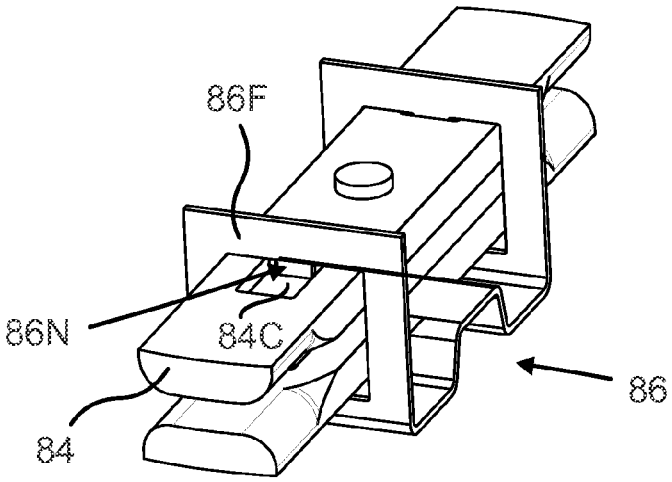
FIG. 17 shows a second view of a movable contact assembled according to an exemplary embodiment of the invention.

FIGS. 16 and 17 show the movable contact in an assembled state from two different viewing angles. FIG. 16 shows the movable contact having the spring member 86 on top, whereas in FIG. 17 the spring member can be on the bottom.

FIG. 16 corresponds to the assembly of FIG. 15, where the top contact blade 82 has been inserted above the bottom contact blade 84. In the assembly of the top contact blade 82, the spring member 86 flexes upwards from the middle so as to allow insertion of the contact blade 82 such that the protrusion in the top contact blade can insert to the respective hole provided in the middle of the spring member 86, which can be the lowest part of the spring member 86 being in contact with the contact blade 82 and thus providing the traction force between the contact blades 82, 84.

FIG. 17 shows the movable contact from the bottom. It can be seen that the locking member 86N of the traction member, which can be a tooth in the horizontal bar 86F of the window, can be locked to the recess 84C of the contact blade 84 such that longitudinal movement of the contact blade with respect to the traction member can be prevented. There can be provided another similar arrangement at the other frame of the traction member.

Thus, in the shown embodiment, the separation members have been arranged to the contact blades to such a position, which coincides with the position of the frames of the traction member 86. The separation member can be thus utilized in two distinct purposes. On the first hand, it separates the contact blade from another contact blade. Secondly, the recess formed when forming the separation member can be utilized in longitudinal locking of the contact blade.

In an exemplary embodiment according to the disclosure, there can be provided a traction member for a movable contact of an electric switch. The traction member includes two frame portions for enveloping a pair of contact blades, and a spring member arranged between the frame portions for providing an attraction force between the contact blades, the traction member further including a locking member for locking the contact blades to the traction member for preventing longitudinal movement of the contact blades with respect to the traction member. The spring member can be attached to the edges of the frames, and the spring member includes a portion that can be closer to the contact blades than the edges of the frames. The traction member includes also a locking member for longitudinal locking of the contact blades. In FIG. 9, this locking member includes two holes 46I, 46J that receive respective protrusions of the contact blades. In FIG. 13, the locking member includes wings 66Q, 66R, which set to respective recesses formed to the contact blades. In FIG. 14, the locking member includes teeth that set to recesses of the first contact blade, which are formed when separation members are formed to the contact blades. The other contact blade can be locked by the locking member 82F of the contact blade being inserted to a hole in the spring middle portion 86A.

The traction member can provide a plurality of purposes. It locks the contact blades such that their longitudinal movement with respect to the traction member can be prevented. Thus also the longitudinal movement of the contact blades with respect to each other can be prevented. The traction member also provides a traction force which attracts the contact blades against each other. The traction also supports the contact blades from the sides, whereby twisting of the contact blades can be prevented.

Thus, it will be appreciated by those skilled in the art that the present invention can be embodied in other specific forms without departing from the spirit or essential characteristics thereof. The presently disclosed embodiments are therefore considered in all respects to be illustrative and not restricted. The scope of the invention is indicated by the appended claims rather than the foregoing description and all changes that come within the meaning and range and equivalence thereof are intended to be embraced therein.

What is claimed is:

1. A movable contact of a rotary switch, comprising:

a pair of contact blades for making an electrical contact to a stationary contact receivable between the contact blades; and a traction member for providing a traction force between the contact blades, wherein the traction member is a unitary piece including: a frame having at least two frame portions which frame the pair of contact blades, and which are arranged at a distance from each other; and a spring portion for pressing one of the contact blades against the other contact blade, wherein the spring portion is arranged between the two frame portions.

2. The movable contact of a rotary switch according to claim 1, wherein the pair of contact blades comprises:

a first contact blade and a second contact blade arranged at a distance from each other to receive the stationary contact between the contact blades, each of the contact blades including a contact surface for making an electrical contact to the stationary contact, and an outer surface opposite to the contact surface.

3. The movable contact of a rotary switch according to claim 2, wherein at least one of the frame portions comprises:

a rectangular form, arranged to support the contact blades from at least one of the outer surfaces and side surfaces arranged between the outer surface and the contact surface in each contact blade.

4. The movable contact of a rotary switch according to claim 2, wherein the spring portion is arranged at least partly against the outer surface of the first contact blade to press the first contact blade against the second contact blade whereby the second contact blade is pressed against the frame which is configured to provide a counter-force to a pressing force of the spring portion.

5. The movable contact of a rotary switch according to claim 1, wherein the frame portions are arranged, in a longitudinal direction of the contact blades, at an equal distance from a middle of a longitudinal length of the contact blades.

6. The movable contact of a rotary switch according to claim 1, wherein the frame portions include horizontal top and bottom walls for limiting the contact blades from separating more than a prevailing distance when the stationary contact is placed between the contact blades.

7. The movable contact of a rotary switch according to claim 1, wherein the spring portion comprises:

end portions that connect to the frame portions, the spring portion being uniformly curved between the frame portions such that a middle of the spring portion is continuously in contact with the first contact blade.

8. The movable contact of a rotary switch according to claim 1, wherein the spring portion comprises:

two substantially planar portions, and a curved portion between the two planar portions pointing towards the first contact blade, the curved portion forming substantially one third of the length of the spring portion.

9. The movable contact of a rotary switch according to claim 4, wherein the traction member comprises:

a support portion, which is arranged to set, between the frame portions, at least partly against the outer surface of the second contact blade.

10. The movable contact of a rotary switch according to claim 9, wherein the support portion is connected to only one of the frame portions.

11. The movable contact of a rotary switch according to claim 1, wherein at least one of the contact blades and the traction member comprises:

locking means for preventing longitudinal movement of the contact blades with respect to the traction member.

12. The movable contact of a rotary switch according to claim 2, wherein at least one of the first contact blade and the second contact blade comprises:

a protrusion on the outer surface of the contact blade for locking the contact blade to the traction member for preventing their mutual longitudinal movement.

13. The movable contact of a rotary switch according to claim 9, wherein at least one of the spring portion setting against the first contact blade and the support portion setting against the second contact blade comprises:

an opening for receiving a protrusion of a contact blade.

14. The movable contact of a rotary switch according to claim 9, wherein the frame portions comprises:

a protrusion on their vertical side bars for setting to a protrusion of a contact blade for locking the contact blade and the traction member longitudinally to each other.

15. The movable contact of a rotary switch according to claim 2, wherein at least one of the first contact blade and the second contact blade comprises:

a receptacle opening to a side of the contact blade for receiving a protrusion of the frame portions for locking the contact blade and the traction member longitudinally to each other.

16. The movable contact of a rotary switch according to claim 2, wherein at least one of the contact blades comprises:

at least one separation member on the contact surface for keeping contact blades at a distance from each other, which separation member has been arranged to the contact blade by punching from the outer surface of the contact blade such that a recess is formed on the outer surface of the contact blade.

17. The movable contact of a rotary switch according to claim 16, wherein the traction member comprises:

a locking member on a horizontal bar of at least one of its frame portions, and the recess of the contact blade is arranged such that the locking member of the frame portion is arranged to lock with the recess of the contact blade.

18. The movable contact of a rotary switch according to claim 3, wherein the a spring portion is arranged at least partly against the outer surface of the first contact blade to press the first contact blade against the second contact blade whereby the second contact blade is pressed against the frame which is configured to provide a counter-force to a pressing force of the spring portion.

* * * * *